US008328187B2

(12) United States Patent
Yasumoto

(10) Patent No.: US 8,328,187 B2
(45) Date of Patent: Dec. 11, 2012

(54) SHEET CONVEYING APPARATUS EXECUTING ORIENTATION CORRECTION

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 12/706,453

(22) Filed: Feb. 16, 2010

(65) Prior Publication Data

US 2010/0207322 A1 Aug. 19, 2010

(30) Foreign Application Priority Data

Feb. 19, 2009 (JP) ..... 2009-037055

(51) Int. Cl.
*B65H 7/02* (2006.01)

(52) U.S. Cl. ..... 271/227; 271/228; 399/395; 399/394

(58) Field of Classification Search ..... 271/227, 271/228; 399/394, 395
See application file for complete search history.

(56) References Cited

U.S. PATENT DOCUMENTS

| | | | | |
|---|---|---|---|---|
| 7,133,573 | B2 * | 11/2006 | Brugger et al. | 382/289 |
| 8,159,728 | B2 * | 4/2012 | Miura et al. | 358/475 |
| 2003/0000988 | A1 * | 1/2003 | Ruhland et al. | 226/20 |
| 2007/0242997 | A1 * | 10/2007 | Takahashi et al. | 399/395 |
| 2008/0193180 | A1 * | 8/2008 | Shim et al. | 399/395 |
| 2009/0033030 | A1 | 2/2009 | Yasumoto | |
| 2011/0084441 | A1 * | 4/2011 | deJong et al. | 271/227 |
| 2011/0200341 | A1 * | 8/2011 | Moriya | 399/16 |
| 2012/0025457 | A1 * | 2/2012 | Inoue | 271/227 |

FOREIGN PATENT DOCUMENTS

| | | |
|---|---|---|
| JP | 11208939 | 8/1999 |
| JP | 2003122223 | 4/2003 |
| JP | 2003146485 | 5/2003 |

* cited by examiner

*Primary Examiner* — Kaitlin Joerger
*Assistant Examiner* — Ernesto Suarez
(74) *Attorney, Agent, or Firm* — Fitzpatrick, Cella, Harper & Scinto

(57) ABSTRACT

In a sheet conveying apparatus a first shape information that expresses at least a part of the outer shape of a sheet. An obtaining unit obtains second shape information that expresses at least the part of the outer shape of the sheet. A correction amount computing unit computes a correction amount of the sheet for correcting an image to be formed on the sheet and/or correcting the position and/or orientation of the sheet based on the first shape information and the second shape information. A correction amount computing unit computes a correction amount for correcting the position and/or orientation of the sheet relative to the conveying direction from the computed skew amount. A position and/or orientation correction unit corrects an image to be formed on the sheet and/or the position and/or orientation of the sheet, according to the computed correction amount.

14 Claims, 10 Drawing Sheets

CT
A1
P1'
P2'
P3'
P4'
P5'
P6'
α1'
α2'
α3'
α4'
S'
F
D
P1
P2
P3
α1
J
J'
βt
βt+Δt
J''//J
R

SHEET CONVEYING APPARATUS EXECUTING ORIENTATION CORRECTION

BACKGROUND OF THE INVENTION

1. Field of the Invention

The present invention relates generally to a sheet conveying apparatus, more specifically an image forming apparatus provided with a sheet conveying apparatus and to a method of conveying a sheet.

2. Description of the Related Art

In an image forming apparatus, skew and position offset of a recording medium may occur during conveyance of the recording medium. This skew or position offset leads to problems such as conveying jams, poor hand-over to a post-processing apparatus, decreased printing precision, and so forth. Therefore, it is desirable for the image forming apparatus to be provided with some sort of skew correction mechanism.

In Japanese Patent Laid-Open No. 11-208939, a mechanism is proposed whereby skew of a recording medium is detected by two sensors, and skew of the recording medium is corrected by two pairs of skew correction rollers.

Recently, printouts have become more diverse, and so there are increasing demands for printing to a recording medium of a size other than a standard size such as A4. Specifically, with the skew correction mechanism of Japanese Patent Laid-Open No. 11-208939, it is not possible to adequately deal with a recording medium that has been cut into a distinctive shape for design (for example, a cloud form or a star-shape or starburst) other than a rectangle. Here, recording media having such a shape, in other words non-rectangular, will be referred to as irregularly shaped media.

A feature of the skew correction mechanism of Japanese Patent Laid-Open No. 11-208939 is that the skew amount is calculated from the difference between the times at which an arbitrary side of the recording medium passes the two sensors. That is, it is assumed that the recording medium has a shape in which a side is comprised of a straight line, such as a rectangle.

However, irregularly shaped media such as a cloud form or a starburst does not have a clear reference side (e.g. a straight or straight-edged side). Therefore, with the skew correction mechanism of Japanese Patent Laid-Open No. 11-208939, it is not possible to accurately detect the skew amount of irregularly shaped media, and so appropriate skew correction cannot be performed.

SUMMARY OF THE INVENTION

A first aspect of the invention provides a sheet conveying apparatus, comprising: a storage unit that stores in advance first shape information that expresses at least a part of an outer shape of a sheet for which an orientation relative to a conveying direction has been designated; an obtaining unit that obtains second shape information that represents at least the part of the outer shape of the sheet, the sheet being conveyed in a conveying path; a skew amount computing unit that computes a skew amount of the sheet conveyed in the conveying path based on the first shape information and the second shape information; a correction amount computing unit that computes a correction amount for correcting the skew of the sheet relative to the conveying direction from the computed skew amount; and a skew correction unit that corrects a skew angle with an image formed on the sheet and the sheet according to the computed correction amount; the obtaining unit comprising: an image-taking unit that takes an image of the sheet conveyed in the conveying path; a position information determining unit that determines position information that represents the respective positions of at least three characterizing points that represent features of the outer shape of the sheet from the image taken by the image-taking unit; and an angle information determining unit that determines angle information that represents an angle formed by two straight lines obtained when the at least three characterizing points are connected by straight lines; wherein the obtaining unit obtains the position information determined by the position information determining unit and the angle information determined by the angle information determining unit as the second shape information.

Further features of the present invention will become apparent from the following description of exemplary embodiments (with reference to the attached drawings).

DESCRIPTION OF THE EMBODIMENTS

Following is a description of embodiments of the present invention. The individual embodiments described below are useful for understanding various concepts of the invention, such as superordinate concepts, intermediate concepts, and subordinate concepts. The scope of the invention is determined by the appended claims, and therefore is not limited by the individual embodiments described below.

Active Registration System

In a first embodiment, a skew correction mechanism will be described whereby orientation correction in the form of skew correction is possible even for irregularly shaped media that does not have a clear reference side such as media in the shape of a starburst or a cloud form. Conventionally, a striking method is known in which skew is corrected by striking a rectangular recording medium against a striking plate that is parallel to a direction orthogonal to the conveying direction. Also, an active registration method as disclosed in Japanese Patent Laid-Open No. 11-208939 is known. In the first embodiment, the active registration method is improved. Note that the recording medium may also be referred to herein as a recording material, sheet, or transfer material. The recording medium may be formed of paper, for example.

Figure 1:
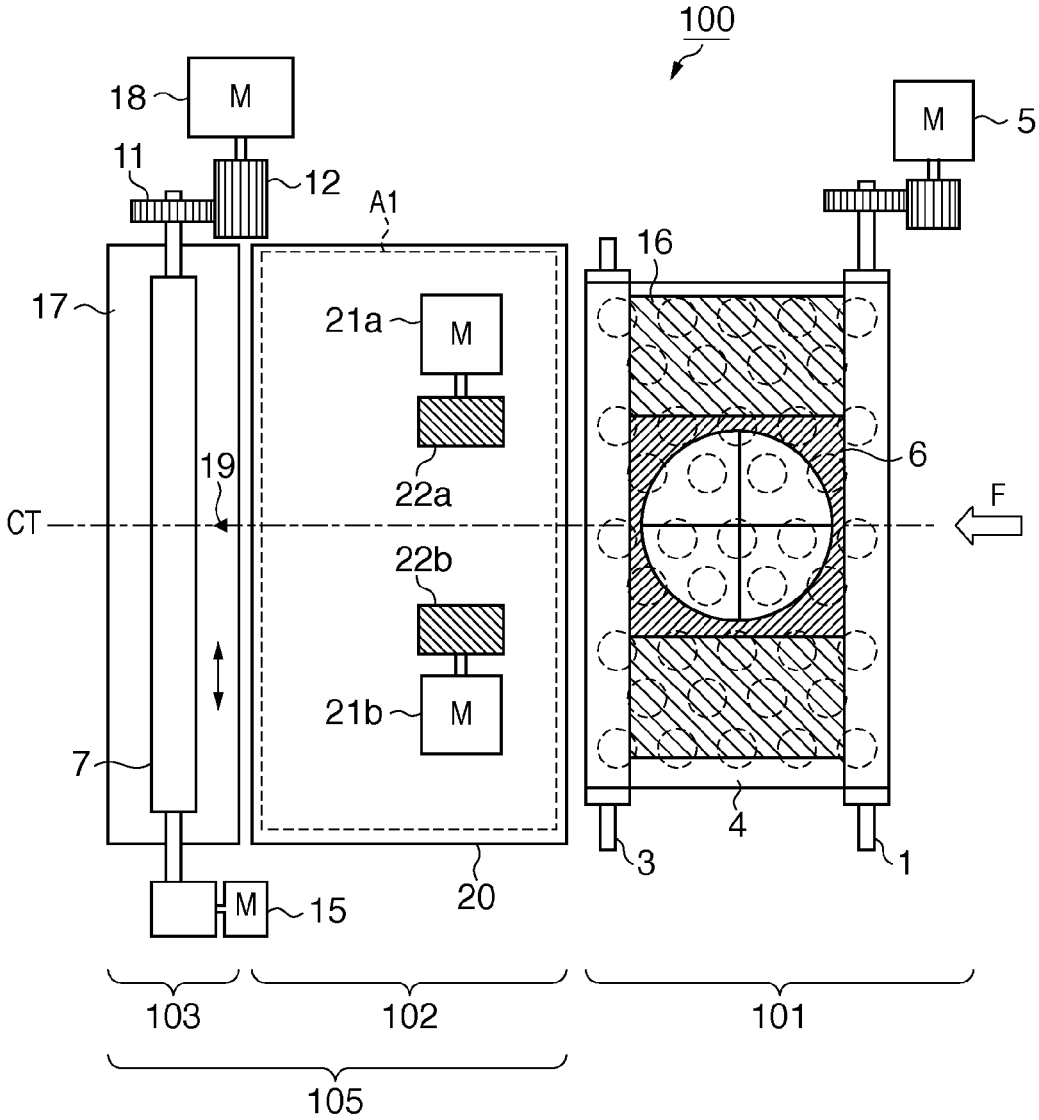
FIG. 1 shows a sheet conveying apparatus 100 that includes a registration apparatus 105 according to an embodiment, viewed from above.

FIG. 1 shows a sheet conveying apparatus 100 that includes a registration apparatus 105 according to an embodiment, viewed from above. Arrow F indicates a conveying direction. A direction orthogonal to the conveying direction is called the width direction. A conveying unit 101, a skew correction unit 102, and a sliding unit 103 are disposed in a line from the upstream side to the downstream side in the conveying direction.

A belt conveying method is adopted in the conveying unit 101. The conveying unit is provided with a belt drive roller 1, a belt driven roller 3, a conveying belt 4, a belt drive motor 5, a suction fan 6, and a shutter 16. The conveying belt 4 is stretched across the belt drive roller 1 and the belt driven roller 3. The belt drive roller 1 is driven by the belt drive motor 5. A transfer material S (not shown) is supported on the conveying belt 4, and is conveyed in the conveying direction indicated by arrow F.

Many holes are provided in the conveying belt 4. When the suction fan 6, provided inside of the ring (loop) of the conveying belt 4, rotates, the transfer material S is tightly fitted to the conveying belt 4 by the suction force of the suction fan 6. Thus, it is possible to suppress offsetting or curling of the transfer material S while being conveyed. When executing skew correction, the shutter 16 closes and so the holes provided in the conveying belt 4 are blocked. Thus, the suction force by the suction fan 6 is cut off, and rotation of the transfer material S in the conveying plane becomes possible.

The conveying unit 101 may be realized by an ordinary pair of conveying rollers. However, conveyability of irregularly shaped media is higher in the case of a suction conveying method employing a conveying belt, as shown in FIG. 1. This is because offsetting or curling during conveyance occurs more easily in the case of irregularly shaped media than in the case of a rectangular transfer material.

The skew correction unit 102 is mainly comprised of conveying guides 20, a first skew correction motor 21*a*, a second skew correction motor 21*b*, a first skew correction roller pair 22*a*, a second skew correction roller pair 22*b*, and an area sensor 23 (not shown in FIG. 1). The first skew correction motor 21*a* drives the first skew correction roller pair 22*a*. The second skew correction motor 21*b* drives the second skew correction roller pair 22*b*. By causing a difference to occur between the rotations of the first skew correction motor 21*a* and the second skew correction motor 21*b*, it is possible to correct skew of the transfer material S. A detection area A1 indicates a range in which an area sensor, described later, is able to detect the transfer material S. The first skew correction roller pair 22*a* and the second skew correction roller pair 22*b* are provided spaced in the width direction orthogonal to the conveying direction of the transfer material, and are an example of two skew correction roller pairs that convey transfer material. The first skew correction motor 21*a* and the second skew correction motor 21*b* are an example of two motors that respectively drive the two skew correction roller pairs.

The sliding unit 103 corrects a transfer material S, whose position has been offset in the width direction, to a correct position. The sliding unit 103 is mainly comprised of a registration roller pair 7, a drive gear 11, a motor gear 12, a conveying guide 17, a motor 18, a sensor 19, and so forth. The registration roller pair 7 is supported so as to be capable of sliding in the width direction in order to correct the detected position offset amount. The registration roller pair 7 slides in the width direction due to rotation of a sliding motor 15. That is, because the registration roller pair 7 slides while sandwiching the transfer material S (in other words while the transfer material is held or gripped between the roller pair 7), the transfer material S also slides along with the registration roller pair 7.

The registration roller pair 7 is driven by the motor 18 via the drive gear 11 and the motor gear 12, which engages with the drive gear 11. The gear tooth width of the motor gear 12 is designed to be sufficiently wide that drive power can be transmitted even when the registration roller pair 7 slides in the width direction.

Figure 2:
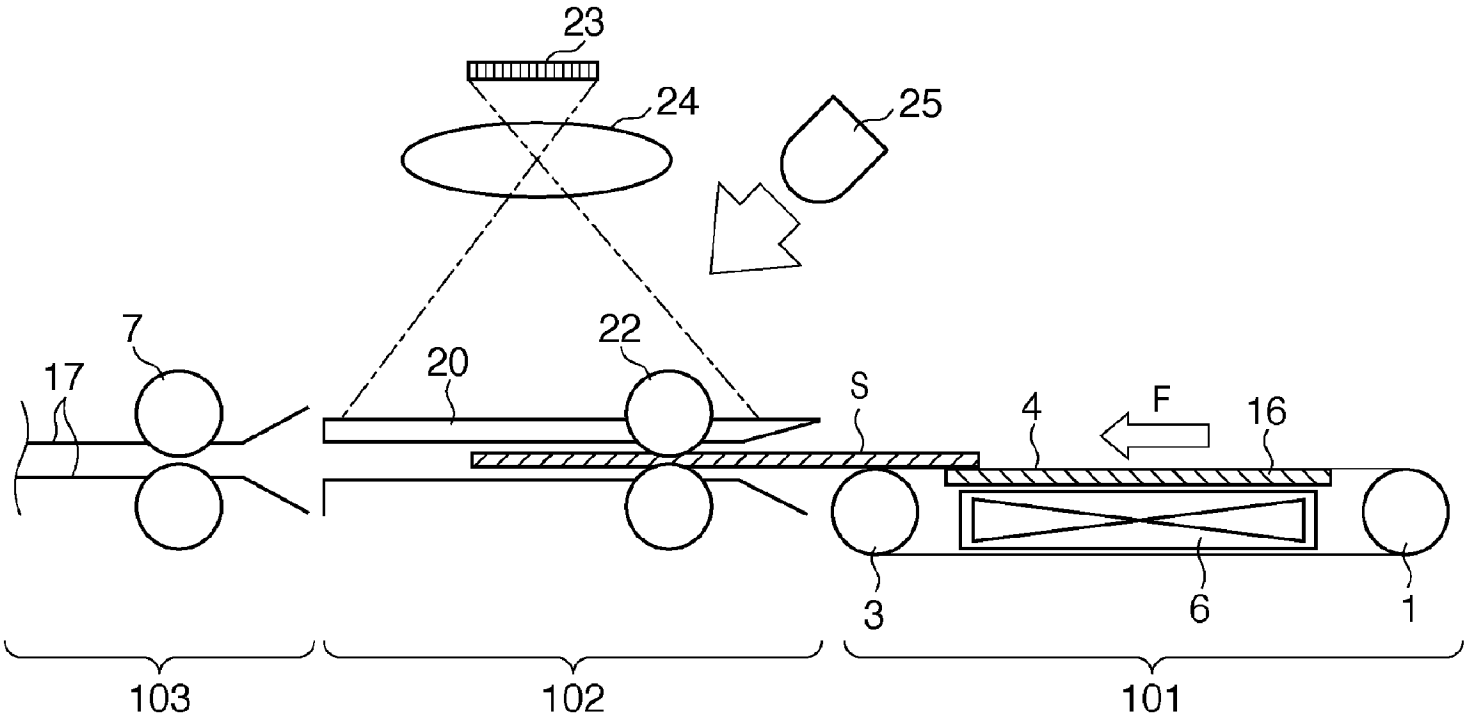
FIG. 2 shows a schematic cross-sectional view of the sheet conveying apparatus 100 according to this embodiment.

FIG. 2 shows a schematic cross-sectional view of the sheet conveying apparatus 100 according to this embodiment. The aforementioned area sensor 23 is, for example, a two-dimensional image sensor such as a CMOS sensor. The area sensor 23 is positioned above the conveying path. A light source 25 irradiates light onto the transfer material S conveyed in the conveying path. Light reflected from the transfer material S is formed into an image on the image sensor of the area sensor 23 by an imaging lens 24. Thus, the area sensor 23 takes an image of the outer shape of irregularly shaped media that has entered into the detection area A1 (see FIG. 1).

In order to allow image-taking of the transfer material S from above the skew correction unit 102, the upper-side conveying guide among the conveying guides 20 may be omitted. Alternatively, a configuration may be adopted in which when taking an image of the transfer material S, the upper-side conveying guide moves away from the detection area A1, and returns above the detection area A1 when image-taking ends. Alternatively, the conveying guide 20 may be formed of a translucent material. This has the advantage that a move-away/return mechanism of the upper-side conveying guide can be omitted.

Registration Control of Irregularly Shaped Media

Figure 3:
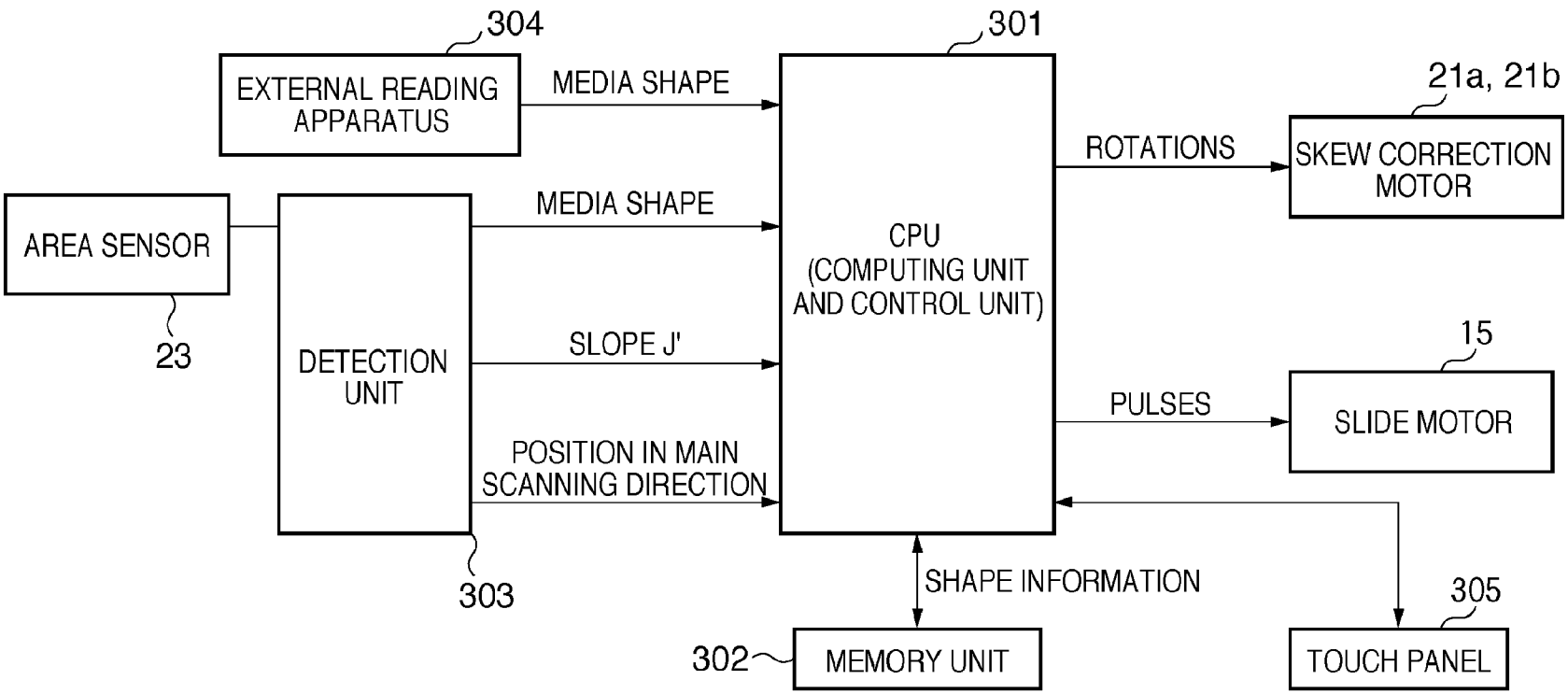
FIG. 3 is a block diagram that shows a system configuration that realizes registration control of irregularly shaped media.

FIG. 3 is a block diagram that shows a system configuration that realizes registration control of irregularly shaped media. The same reference numerals to items have been assigned to items that have already been described.

A CPU 301 is a control unit that executes various computation and control operations. A memory unit 302 is a ROM, a RAM, or the like, and is a unit that stores data and computer programs necessary for registration control. A detection unit 303 detects the outer shape or outline of a recording medium from an image of the recording medium obtained by the area sensor 23, and outputs a media shape, skew, and position of the recording medium in the width direction. The detection unit 303 may be realized by the CPU 301.

An external reading apparatus 304 is a so-called image reader or image scanner. The external reading apparatus 304 is used in order to obtain the outer shape (media shape) of the recording medium. The area sensor 23 can be used in place of the external reading apparatus 304, and so the external reading apparatus 304 may also be omitted. The area sensor 23 and the external reading apparatus 304 are examples of an image-taking unit.

A touch panel 305 is a unit in which a display apparatus that displays information and an input apparatus that inputs information are integrated. An independent display apparatus and input apparatus (in other words separate display apparatus and input apparatus) may be provided instead of the touch panel 305.

When performing registration control of irregularly shaped media, it is necessary to define a control target. In the present embodiment, a mode is provided for inputting in advance shape information of irregularly shaped media (referred to below as a shape recognition mode). The shape recognition mode is a different mode than a job mode, which is a job mode for forming an image on the transfer material S.

I. Shape Recognition Mode

Figures 4A, 4B:
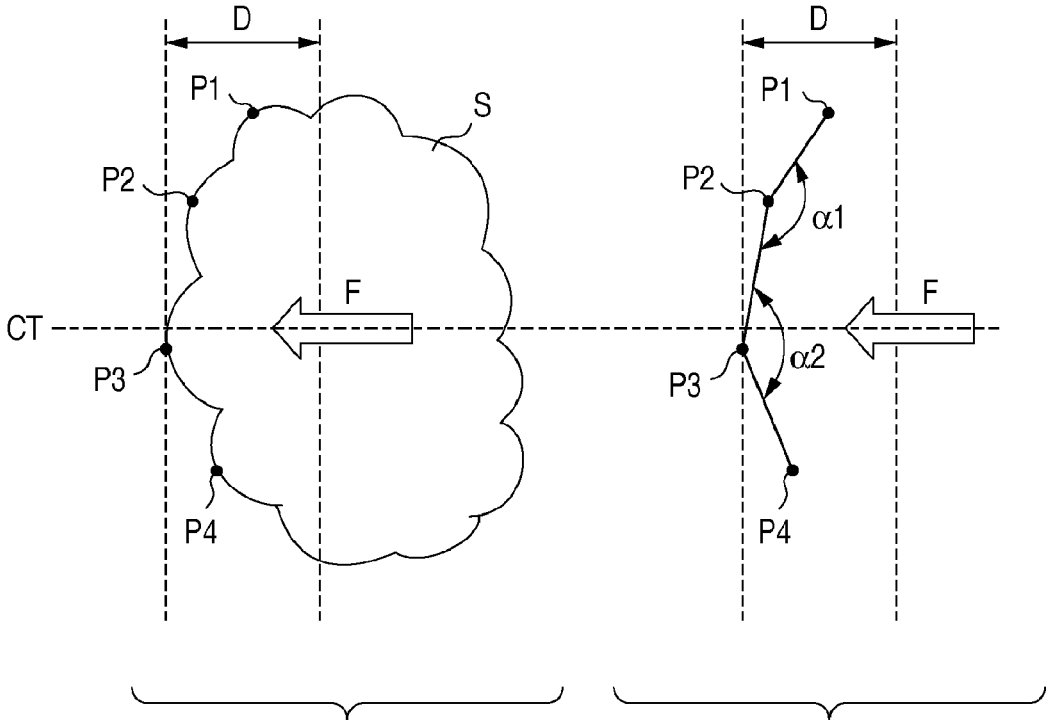
FIGS. 4A and 4B illustrate a concept of a shape recognition mode.

FIGS. 4A and 4B illustrate the concept of the shape recognition mode. Arrow F indicates the conveying direction of the transfer material S. FIG. 4A shows the outline of a transfer material S having a cloud form, and characterizing points (e.g. inflexion points, stationary point extremum, vertex and/or corner) of the outline. FIG. 4B shows a media shape obtained by connecting points P1, P2, P3, and P4, which are the characterizing points extracted from the transfer material S having a cloud form, in order by straight lines. Here the characterizing points are referred to as inflexion points. The term "inflexion point" is used as a general term referring to a point at which a slope of an outline changes. Inflexion point includes, inter alia, stationary points (in the form of local maxima and/or minima). In a preferred embodiment the characterizing points may each be local maxima. The inflexion points are preferably subsequent to each other in the outline so in other words there is preferably no inflexion point of the same type (e.g. local maxima) positioned in the outline between the points P1, P2, P3 and P4. An angle $\alpha$1 is formed by a straight line that connects points P3 and P2 and a straight line that connects points P2 and P1. An angle $\alpha$2 is formed by a straight line that connects points P4 and P3 and a straight line that connects points P3 and P2. As is clear from FIGS. 4A and 4B, angles $\alpha$1 and $\alpha$2 correspond to an inner (or interior) angle of a representation of the outline obtained by using the characterizing points to simplify the outer shape of the transfer material S. Letter D in the drawings indicates the distance from the side of the detection area A1 on the upstream side in the conveying direction to the position where sandwiching begins by the first skew correction roller pair 22*a* and the second skew correction roller pair 22*b*. In the case of a transfer material S that does not fit within the detection area A1, not the entire shape, but rather only part of the shape of the transfer material S is used for registration control. CT in the drawings indicates the center of the conveying path (conveying center).

Figure 5:
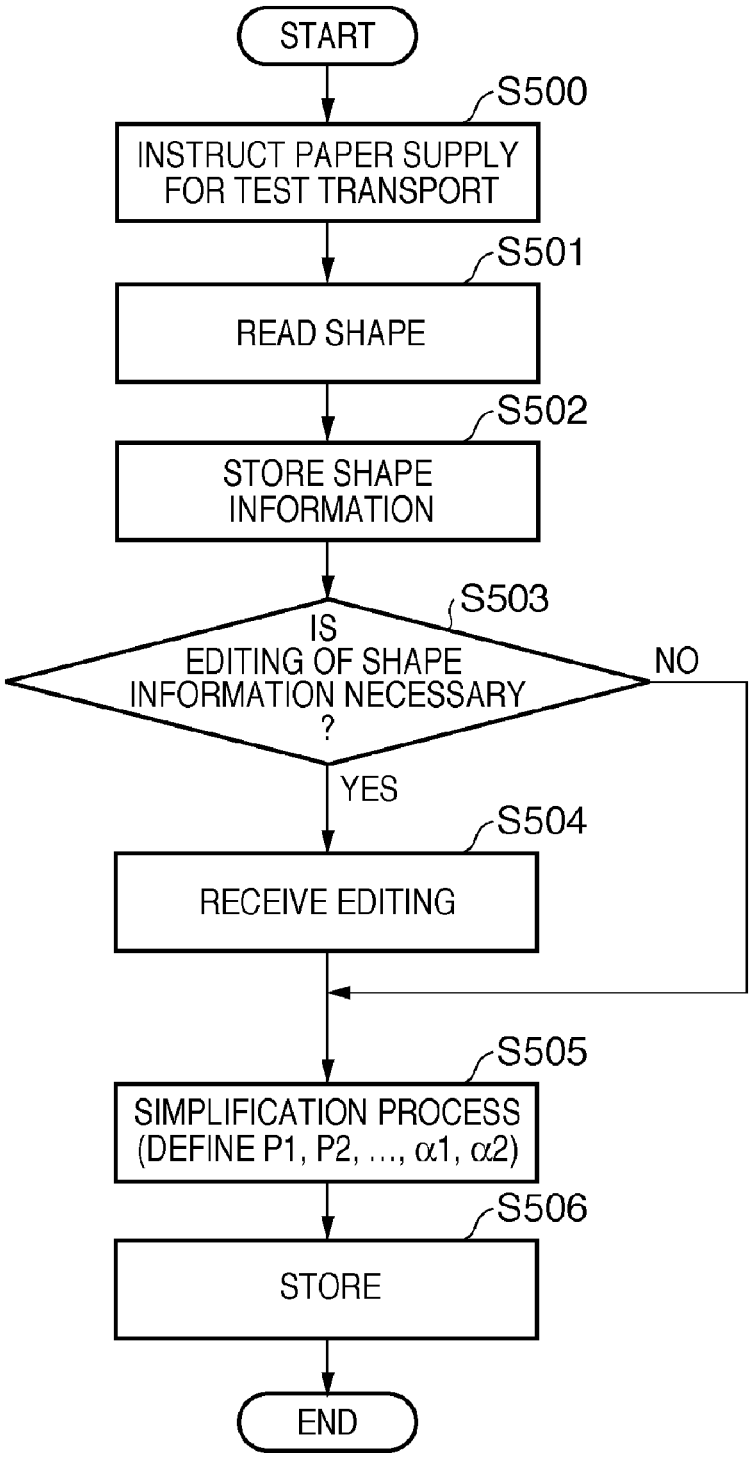
FIG. 5 is a flowchart that illustrates a shape recognition mode according to this embodiment.

FIG. 5 is a flowchart that illustrates the shape recognition mode according to this embodiment. When the CPU 301 recognizes that the shape recognition mode has been selected in the touch panel 305, the CPU 301 switches to the shape recognition mode, from e.g. the job mode.

In Step S500, the CPU 301 executes a test supply of the transfer material S. For example, the CPU 301 displays a message for urging the user to place transfer material S in a manual feed supply unit and press a reading start button in the touch panel 305. When the reading start button displayed in the touch panel 305 is pressed, the CPU 301 sends a paper supply command to a drive circuit of a paper supply motor. Thus, supply and conveying of the transfer material S is started.

In Step S501, the detection unit 303 uses the area sensor 23 to obtain an image of the transfer material S. The operator places the transfer material S in the manual feed supply unit of the sheet conveying apparatus 100 in a determined orientation relative to the conveying direction. The area sensor 23 obtains an image of at least a part of the transfer material S, that has been conveyed in the determined orientation relative to the conveying direction. The transfer material S may become skewed also when performing this test conveyance. In this case, in Step S504 the shape information is modified so that the transfer material S is oriented in a desired conveying direction by rotating the image by a desired angle. When obtaining an image of the transfer material S with the external reading apparatus 304, when the operator presses the reading start button after placing the transfer material S on an original placement glass of the external reading apparatus 304 in the determined orientation relative to the conveying direction, the external reading apparatus obtains an image of the transfer material S. When using the external reading apparatus, the orientation relative to the conveying direction is easily determined, so there is little necessity to modify the shape information. However, in this case as well, work to modify the shape information may be carried out in Step S504.

In Step S502, the detection unit 303 extracts the outer shape (outline) of the transfer material S from the obtained image using a known technique, and creates information regarding curves or straight lines that express the outline as shape information. The image may be a multi-color image, but a binary image is sufficient for extracting the outline. Thus, the detection unit 303 functions as an outline extracting unit that extracts an outline of a recording medium from an image obtained by an image-taking unit. The CPU 301 stores the shape information that has been created by the detection unit 303 in the memory unit 302. Thus, the memory unit 302 is an example of a storage unit where first shape information that expresses the outer shape of at least a part of a recording medium, whose orientation relative to the conveying direction has been designated, is stored in advance.

In Step S503, the CPU 301 judges whether or not editing of shape information is necessary. For example, the CPU 301 displays a message for inquiring as to whether or not to execute editing of the shape information in the touch panel 305. When operation (e.g. command) instructing to execute editing is received, the CPU 301 judges that editing of the shape information is necessary. In this case, processing proceeds to Step S504. When operation instructing not to execute editing is received, the CPU 301 judges that editing of the shape information is not necessary. In this case, processing proceeds to Step S505.

In Step S504, the CPU 301 receives editing of the shape information via the touch panel 305. For example, the CPU 301 reads out the shape information from the memory unit 302 and displays that shape information in the touch panel 305. The operator designates a correct paper transport (conveying) direction for the outline of the transfer material S displayed in the touch panel 305, and designates detailed information such as print layout. The CPU 301 edits the shape information according to the editing content that has been input from the touch panel 305, and again stores the edited shape information in the memory unit 302. Thus, the touch panel 305 and the CPU 301 function as a display unit that displays first shape information stored in a storage unit, and an editing unit that edits displayed first shape information. Also, the touch panel 305 and the CPU 301 function as a modification unit that modifies first shape information according to the conveying direction of the recording medium.

In Step S505, the CPU 301 executes processing to simplify the shape information. The information for precisely reproducing the outline of the transfer material S is likely to become relatively large. On the other hand, information of a precise outline is not absolutely necessary in registration control. Consequently, the shape information is simplified to position information that expresses the respective positions of at least three characterizing points that express features of the outer shape of the transfer material S. Furthermore, the shape information may be simplified to angle information that expresses an angle formed by two straight lines obtained when at least three characterizing points are connected by straight lines in order. The details of the simplification process will be described below. In Step S506, the CPU 301 stores shape information that has undergone the simplification process in the memory unit 302.

Here, the simplification process for irregularly shaped media that does not have a clear reference side will be described in detail with reference to FIGS. 4A and 4B. It is assumed that the irregularly shaped media S having an outer shape that is a cloud form has been designated to be conveyed in the orientation shown in FIGS. 4A and 4B relative to the conveying center line CT. The CPU 301 reads out the shape information from the memory unit 302, extracts characterizing points that express features of the outer shape of the transfer material S, and simplifies the shape information.

Here, inflexion points are adopted as characterizing points. The CPU 301 extracts inflexion points of a line that expresses the outline of the transfer material S from the shape information that has been read out using a known technique. The CPU 301 is an example of an inflexion point determining unit that determines extracted inflexion points of an outline as characterizing points. Here, points P1, P2, P3, and P4 are inflexion points that have been extracted. The CPU 301 stores coordinates (position information) that indicate the respective positions of these inflexion points as simplified shape information in the memory unit 302.

It is not essential to know the entire outer shape in order to perform skew correction using an active registration method; it is sufficient to know only the shape of the leading edge side (downstream side) in the conveying direction. Shape matching (recognition) can be performed in an interval from the time when the leading edge of the transfer material S enters into the detection area A1 until the time when the transfer material S is sandwiched by the skew correction roller pair. The distance of the interval in which shape matching is performed is denoted by letter D, as stated above. Thus, the simplification process may be executed in the period up until the leading edge of the transfer material S is conveyed the distance D. Thus, at least a part of the transfer material S serving as the basis for the shape information is a part of the transfer material S that is contained within the image-taking area (detection area A1) of the image-taking unit.

As shown in FIGS. 4A and 4B, the CPU 301 extracts position information of the points P1, P2, P3, and P4 within the range of the distance D from the leading edge of the transfer material S. The CPU 301 functions as a position information determining unit that determines position information that expresses the respective positions of at least three characterizing points that express features of the outer shape of a recording medium.

Furthermore, the CPU 301 recognizes a shape as shown in FIG. 4B by connecting these points in order. As described above, the angle formed by line segment P1-P2 and line segment P2-P3 is defined as $\alpha 1$, and the angle formed by line segment P2-P3 and line segment P3-P4 is defined as $\alpha 2$. The CPU 301 may also store the items of angle information $\alpha 1$ and $\alpha 2$ as part of the shape information in the memory unit 302. As a result, position information and angle information may be included in the shape information. Thus, the CPU 301 functions as an angle information determining unit that determines angle information that expresses an angle formed by two straight lines obtained when at least three characterizing points are connected, in order, with straight lines.

Also, the CPU 301 may store the distance between the respective characterizing points, that is, the length of the line segment P1-P2 and the length of the line segment P2-P3, as part of the shape information in the memory unit 302. It is not essential for these angles and line segment lengths to be stored in advance in the memory unit 302, because they can be easily computed when the position information of each characterizing point is known.

As described above, initial data for shape information is obtained by the external reading apparatus 304 and the area sensor 23. Thus, the CPU 301 is an example of a write unit that writes, to a storage unit, first shape information determined from an image obtained by reading a recording medium in an original reading apparatus. Further, the CPU 301 is an example of a write unit that obtains first shape information with an obtaining unit by performing trial conveyance of a recording medium, and writes the first shape information to a storage unit.

The shape information that has thus been stored in advance in the memory unit 302 becomes a control target in registration control. That is, the CPU 301, using the shape information stored in the memory unit 302 as reference data, compares this shape information to the shape information of the transfer material S to be used in image forming, and executes skew correction. By providing a shape recognition mode, it is possible to confer information necessary for specifying the position and orientation of irregularly shaped media that does not have a clear reference side.

II. Job Mode

FIGS. 6A to 6D illustrate a concept of registration control in a job mode. Registration control performed in the job mode is based on pattern matching using shape information stored in the memory 302 in the shape recognition mode. In FIGS. 6A to 6D, a shape determined from reference data is indicated by a broken line, and shape information detected by the area sensor 23 in real time during conveyance of the transfer material is indicated by a solid line.

Figure 6A:
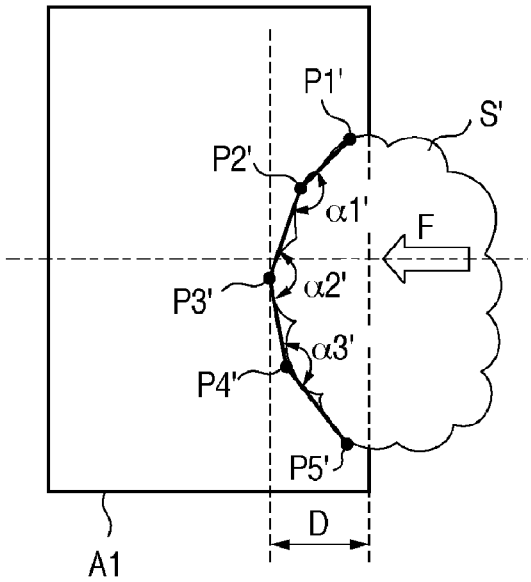
FIGS. 6A to 6D illustrate a concept of registration control in a job mode.
Figure 6B:
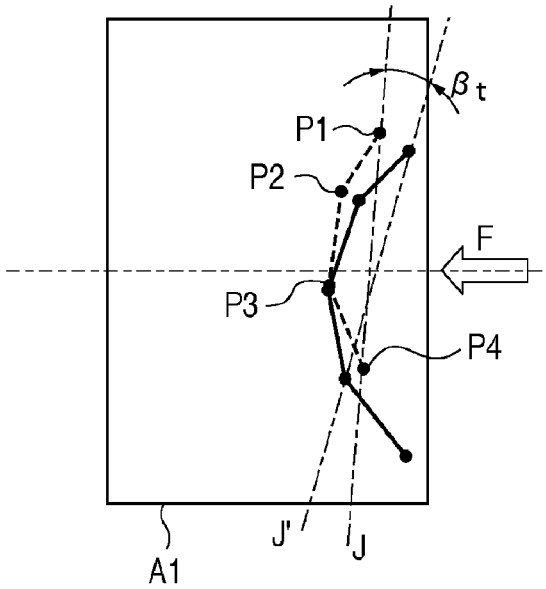
Figure 6C:
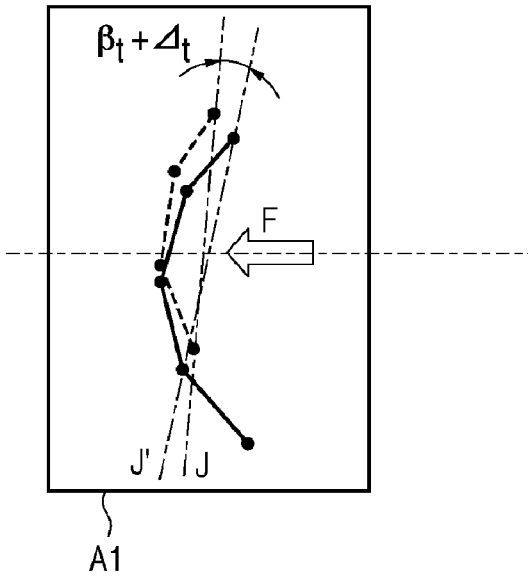
Figure 6D:
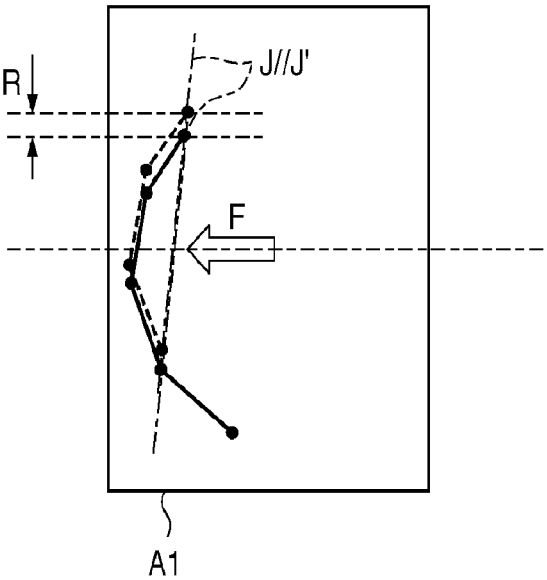

As shown in FIGS. 6A to 6D, the registration control includes a first phase (FIG. 6A), a second phase (FIG. 6B), a third phase (FIG. 6C), and a fourth phase (FIG. 6D). In the first phase (FIG. 6A), the instant when the leading edge of a transfer material S' has entered the detection area A1 and has been conveyed the distance D is shown. Furthermore, the detection unit 303 again uses the algorithm used in the shape recognition mode to read the conveyed transfer material S', and execute the simplification process for the shape information of that transfer material.

Incidentally, in the first phase shown in FIG. 6A, five characterizing points (points P1', P2', P3', P4', and P5') are extracted. Information regarding the positions of four points is included in the reference data. Therefore, there is one more characterizing point than points of position information in the reference data. The reason for this is that skew of the transfer material S' has occurred.

Thus, in the present instance, it is necessary for the detection unit 303 to exclude one characterizing point from the five characterizing points. The detection unit 303 deletes (or ignores) an unnecessary characterizing point based on the angles formed by the line segments. The detection unit 303 computes angles $\alpha 1'$, $\alpha 2'$, and $\alpha 3'$ (corresponding to inner angles in the illustration) formed between line segments obtained when connecting the five characterizing points in order by straight lines. These angles can be easily computed from the coordinate data of each characterizing point. The detection unit 303 compares the data of angles $\alpha 1$ and $\alpha 2$ included in the reference data to the data of the computed angles $\alpha 1'$, $\alpha 2'$, and $\alpha 3'$, and judges whether or not any of $\alpha 1$ and $\alpha 2$ matches any of $\alpha 1'$, $\alpha 2'$, and $\alpha 3'$. When angle data is not included in the reference data, the detection unit 303 computes $\alpha 1$ and $\alpha 2$ from the coordinate data of each characterizing point.

In the example shown in FIGS. 6A to 6D, the detection unit 303 finds the corresponding relationships $\alpha 1'=\alpha 1$ and $\alpha 2'=\alpha 2$. Furthermore, from the results of angle comparison, the detection unit 303 specifies P1'=P1, P2'=P2, P3'=P3, and P4'=P4. The detection unit 303 excludes the angle $\alpha 3'$ that did not match an angle in the reference data, and as a result, excludes the characterizing point P5'. As will be appreciated, this is because the characterizing point P5' is information that has been mistakenly included due to the effect of skew.

In the second phase (FIG. 6B), the detection unit 303 determines a straight line J that connects two characterizing points among at least three characterizing points included in the shape information (reference data) read out from the memory unit 302. Furthermore, the detection unit 303 determines a straight line J' that connects two characterizing points among at least three characterizing points included in the shape information for the transfer material S' obtained using the area sensor 23. The two characterizing points for determining the straight line J' correspond to the two characterizing points for determining the straight line J. In FIGS. 6A to 6D, the points P1' and P4' of the transfer material S' correspond to the points P1 and P4 of the reference data. In the present embodiment, in order to measure how far the shape information detected in real time is offset from the target value, the most distant two points P1 and P4, and P1' and P4', among the characterizing points that have been pattern-matched are adopted.

Incidentally, in order to correct skew of the transfer material S' it is necessary to specify the skew amount, and determine a correction amount (difference in rotations between the first skew correction roller pair 22*a* and the second skew correction roller pair 22*b*) for canceling the skew. The phenomenon referred to as skew is a change in orientation caused by rotation of the transfer material S' in the conveying plane. Thus, an element of the skew amount is an angle.

Therefore, the detection unit 303 computes an angle $\beta t$ formed by the straight line J and the straight line J'. Here, the suffix t is added to $\beta$ in order to make it clear that this is the angle at time t. The angle $\beta t$ is the skew amount. Actually, position offset of the transfer material S' in the width direction may occur in addition to skew. In the active registration method, the main focus is deleting skew, so attention is only given to $\beta t$.

Thus, when the straight line J and the straight line J' are not parallel ($\beta t \neq 0$), the CPU 301 computes a conveying amount (rotations of the first skew correction roller pair 22*a* and the second skew correction roller pair 22*b*) necessary for canceling the skew amount of the angle $\beta t$. In order to bring the angle $\beta t$ near zero, a difference between the rotations of the first skew correction roller pair 22*a* and the rotations of the second skew correction roller pair 22*b* may be caused. Thus, the skew correction amount is converted to a difference in rotations.

In the third phase (FIG. 6C), a time $\Delta t$ has further passed after the second phase. At time $t+\Delta t$, by controlling the rotations of the first skew correction roller pair 22*a* and the rotations of the second skew correction roller pair 22*b*, the skew amount is reduced (angle $\beta t$>angle $\beta t+\Delta t$). Also, at this point in time, the skew amount has not become zero, so the CPU 301 again computes a necessary difference in rotations. The CPU 301 corrects skew by applying the computed difference in rotations to the first skew correction roller pair 22*a* and the second skew correction roller pair 22*b*.

By repeating such a skew correction process several times, the skew amount ultimately becomes near zero. Thus, by utilizing the area sensor 23, it is possible to monitor the skew amount continuously while transfer material is being conveyed, so skew correction can be executed in real time during conveyance.

In the fourth phase (FIG. 6D), the CPU 301 judges that the straight line J and the straight line J' have become parallel (skew amount=0), and ends skew correction. At this point in time, the CPU 301 switches focus from detection of the skew amount to detection of the offset amount in the width direction. For example, the position offset of the transfer material S' in the width direction is detected from a difference R between the position of point P1 and the position of point P1' in the width direction. The CPU 301 drives the sliding motor 15 while the transfer material S' is sandwiched by the registration roller pair 7 in order to correct the detected offset amount R. The sliding motor 15 reduces the position offset of the transfer material S' by moving the registration roller pair 7 in a sliding manner in the width direction. For example, from the offset amount R, the CPU 301 computes a number of drive pulses of the sliding motor 15 necessary to slide the transfer material S' by the offset amount R. The CPU 301 can judge whether or not the transfer material S' has been sandwiched by the registration roller pair 7 from a pass signal from the sensor 19 (or in other words from s signal from the sensor 19 that the transfer material S' has passed the sensor 19).

Figure 7:
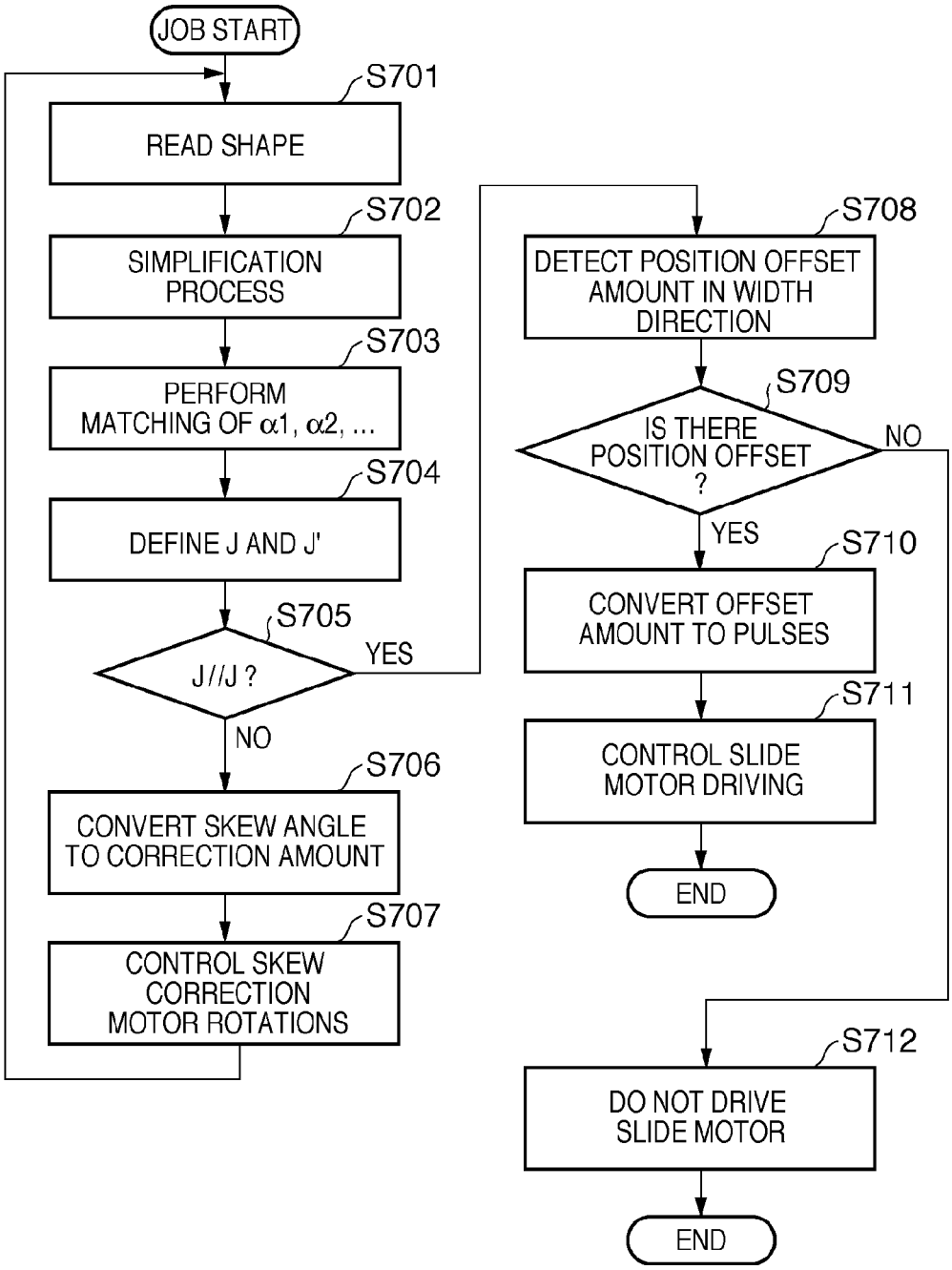
FIG. 7 is a flowchart that illustrates a job mode according to this embodiment.

FIG. 7 is a flowchart that illustrates a job mode according to this embodiment. In Step S701, the detection unit 303 obtains an image of the transfer material S' read by the area sensor 23. Further, the detection unit 303 extracts the outer shape (outline) of the transfer material S' from the obtained image, and creates information regarding curves or straight lines that express the outline as shape information. The processing in Step S701 is the same as in Steps S501 and S502. Thus, the detection unit 303 and the CPU 301 function as an obtaining unit that obtains second shape information that expresses at least a part of the outer shape of a recording medium that has been conveyed in a conveying path.

In Step S702, the CPU 301 simplifies the shape information of the transfer material S'. The processing in Step S702 is the same as in Step S505. In Step S703, the CPU 301 matches (compares) the angles $\alpha 1$ and $\alpha 2$ related to the reference data to the angles $\alpha 1'$, $\alpha 2'$, and $\alpha 3'$ of the transfer material S', and determines corresponding relationships. Further, the CPU 301 specifies the points P1', P2', P3', and P4' that correspond to the points P1, P2, P3, and P4 related to the reference data.

In Step S704, the CPU 301 determines two characterizing points necessary for determining the skew amount. The CPU 301 repeatedly combines (or selects) two points from the points P1, P2, P3, and P4, computes the distance between the two combined (or selected) points, and preferably specifies the two points having the greatest distance between them. Likewise, the CPU 301 combines two points from the points P1', P2', P3', and P4', computes the distance between the two combined points, and specifies the two points having the greatest distance. Here, the pair of points P1 and P4, and the pair of points P1' and P4', are the combinations for which the distance between two points is greatest. The CPU 301 determines an equation of the straight lines J and J' that connect the two specified points. The straight line J passes through points P1 and P4. The straight line J' passes through points P1' and P4'.

In Step S705, the CPU 301 judges whether or not the straight line J and the straight line J' are parallel. For example, the CPU 301 computes the angle $\beta t$ formed by the straight line J and the straight line J'. The straight line J corresponds to a straight line that connects two characterizing points among at least three characterizing points included in the first shape information. The straight line J' corresponds to a straight line that connects two characterizing points, corresponding to two characterizing points in the first shape information, from among at least three characterizing points included in the second shape information. Thus, the CPU 301 functions as an angle computing unit that computes the angle $\beta t$ formed by the straight line J and the straight line J'.

Further, the CPU 301 judges whether or not the angle $\beta t$ is 0 (or is substantially 0 or falls within a predefined error range). The angle $\beta t$ does not necessarily have to be 0. It is sufficient that the angle $\beta t$ is contained within the range of error determined by usage of the apparatus. When the straight line J and the straight line J' are not parallel, the transfer material S' is skewed. Thus, processing proceeds to Step S706 in order to execute skew correction. However, if the angle βt indicates that the lines J and J' are parallel or substantially parallel no skew correction is required and the processing proceeds directly to step S708. This may occur before any skew correction processing has been performed or may occur after sufficient skew correction processing has been performed. The angle βt is the initial skew amount (skew angle). The CPU 301 is an example of a skew amount computing unit that compares the first shape information to the second shape information to compute the skew amount of a recording medium that has been conveyed in a conveying path.

In Step S706 the CPU 301 converts the skew amount to a correction amount. That is, the CPU 301 determines the rotations of the first skew correction roller pair 22*a* and the rotations of the second skew correction roller pair 22*b* necessary in order to set the angle βt to zero. When these rotations are the same, the transfer material S' is conveyed without rotating in the conveying plane. However, when there is a difference between these rotations, the transfer material S' rotates in the conveying plane. In the present embodiment, this principle is utilized to reduce the skew amount. The CPU 301 is an example of a correction amount computing unit that computes a correction amount for correcting skew of a recording medium relative to the conveying direction from the computed skew amount. Thus, the CPU 301 functions as a conversion unit that converts a correction amount to rotations in two motors based on an angle.

In Step S707, the CPU 301 applies the respectively determined rotations to the first skew correction roller pair 22*a* and the second skew correction roller pair 22*b*. That is, the CPU 301 controls the first skew correction motor 21*a* and the second skew correction motor 21*b* such that the first skew correction roller pair 22*a* and the second skew correction roller pair 22*b* rotate by the determined rotations. Steps S701 to S707 are repeatedly executed until the straight line J and the straight line J' are parallel. When the straight line J and the straight line J' are parallel, processing proceeds to Step S708. Thus, the first skew correction roller pair 22*a* and the second skew correction roller pair 22*b* are an example of a skew correction unit that corrects a skew angle of the sheet according to a computed correction amount.

In Step S708, the detection unit 303 detects the position offset amount of the transfer material S' in the width direction. As described above, the distance between an arbitrary characterizing point of the transfer material S' and a corresponding characterizing point of the reference data corresponds to the position offset amount. The detection unit 303 functions as a position offset amount determining unit that determines a position offset amount in the direction orthogonal to the conveying direction of a recording medium that has been conveyed in a conveying path from first shape information and second shape information.

In Step S709, the CPU 301 judges whether or not the position of the transfer material S' is offset in the width direction. That is, the CPU 301 judges whether or not the position offset amount is zero. If there is no position offset, in Step S712 the CPU 301 prohibits or omits (so does not perform) driving of the sliding motor 15. On the other hand, if there is position offset, processing proceeds to Step S710.

In Step S710, the CPU 301 converts the position offset amount to pulses of the sliding motor 15. In Step S711, the CPU 301 drives the sliding motor 15 according to the determined pulses. Thus, the registration roller pair 7 slides to correct the position offset of the transfer material S' in the width direction. The sliding motor 15 functions as a position offset amount correction unit that is provided downstream from the skew correction unit in the conveying path, and corrects the position offset amount of a recording medium. The registration roller pair 7 is an example of a registration roller pair that is capable of sliding in the direction orthogonal to the conveying direction.

As described above, according to the present embodiment, shape information of a transfer material is stored in advance, and skew of the transfer material can be corrected by comparing the stored shape information to shape information of a transfer material that has been conveyed. In particular, it is possible to maintain registration accuracy even in the case of irregularly shaped media that does not have a rectangular shape.

For example, position information that expresses the respective positions of at least three characterizing points that express features of the outer shape of a transfer material is used as shape information. Angle information that expresses an angle formed by two straight lines obtained when three or more characterizing points are connected in order by straight lines may also be used as shape information. Thus, when characterizing points of the outline of a transfer material are used, registration control can be executed with a comparatively small amount of calculation. In particular, a smaller amount of calculation is better for repeatedly executing skew correction during a short period of time.

It is desirable to reduce the size of the detection area A1 in order to adopt an inexpensive configuration for the area sensor 23. However, when the detection area A1 is small, the area sensor 23 cannot take an image of the entire shape of a transfer material. Consequently, in the present embodiment, by extracting an outline of a part of the transfer material from an image of the transfer material, and further extracting inflexion points of the outline, it is possible to efficiently specify the outer shape of the transfer material.

In the present embodiment, the angle βt formed by the straight line J that connects two characterizing points among several characterizing points constituting reference data and the straight line J' that connects two characterizing points of the transfer material S' that is the target of skew correction is computed. This angle βt corresponds to the skew amount, and a value obtained by inverting the sign of the angle βt is the correction amount. By defining two straight lines in this way, it is possible to determine the skew amount and the correction amount with a comparatively small amount of calculation.

Also, with a method in which two skew correction roller pairs are used as a skew correction mechanism, it is possible to simply and easily ensure correction accuracy. This is because by giving a difference in rotations to the two skew correction roller pairs, it is possible to easily cause the transfer material to rotate in the conveying plane.

Ordinarily, a registration roller pair is often disposed immediately before the position where an image is transferred. Therefore, it is desirable that skew of a transfer material is corrected before the transfer material arrives at the registration roller pair. On the other hand, position offset of a transfer material in the width direction can be corrected with a registration roller pair capable of sliding in the width direction. Thus, it is rational that a skew correction mechanism is positioned on the upstream side of the conveying path, and a position offset correction mechanism is disposed on the downstream side of the skew correction mechanism.

In the present embodiment, the CPU 301 performs a trial conveyance of the transfer material S, obtains shape information used as reference data with the area sensor 23, and writes the obtained shape information to the memory unit 302. However, a configuration may also be adopted in which an image of the transfer material S is obtained by the external reading apparatus 304, and the detection unit 303 creates shape information from this image.

In the present embodiment, it is important for maintaining registration accuracy that the reference data is accurately created. It is sufficient that the transfer material S is correctly disposed on a glass platen in the external reading apparatus 304. However, when the transfer material S that has been conveyed in a trial is read by the area sensor 23, there is a possibility that skew will occur. Consequently, in the present embodiment, a configuration is adopted in which the shape information used as reference data can be edited, and thus the effects of skew can be mitigated when creating reference data. This editing is work to modify the reference data according to the conveying direction.

In the present embodiment, the area sensor 23 can be used both for detection for skew correction and for detection for adjusting position in the width direction. Of course, these two types of detection may also be realized with separate sensors, but use of a single sensor is advantageous from the perspective of cost.

The algorithms for the shape simplification process and the pattern matching process described in the present embodiment are only examples. Other algorithms may be adopted as long as the same effects are obtained.

Incidentally, it is not the case that both of the two skew correction roller pairs always sandwich the irregularly shaped media. When control of rotations of the skew correction motors is performed in a state in which only one skew correction roller pair is sandwiching the irregularly shaped media, there is a risk that the irregularly shaped media will be turned more than expected. Consequently, in the present embodiment, it is desirable that the area sensor 23 always monitors the relative positions of the two skew correction roller pairs and the irregularly shaped media. That is, the CPU 301 executes control of rotations of the skew correction motors only while both skew correction roller pairs are sandwiching a transfer material. It is possible to judge whether or not both skew correction roller pairs are sandwiching a transfer material based on the shape information of the transfer material stored in the memory unit 302, the conveying speed of the transfer material, and the time that has passed since the start of conveyance.

In a second embodiment, registration control for a different type of irregularly shaped media will be described. Here, the hardware configuration is the same as in the first embodiment, and therefore is only described briefly.

Figures 8A, 8B:
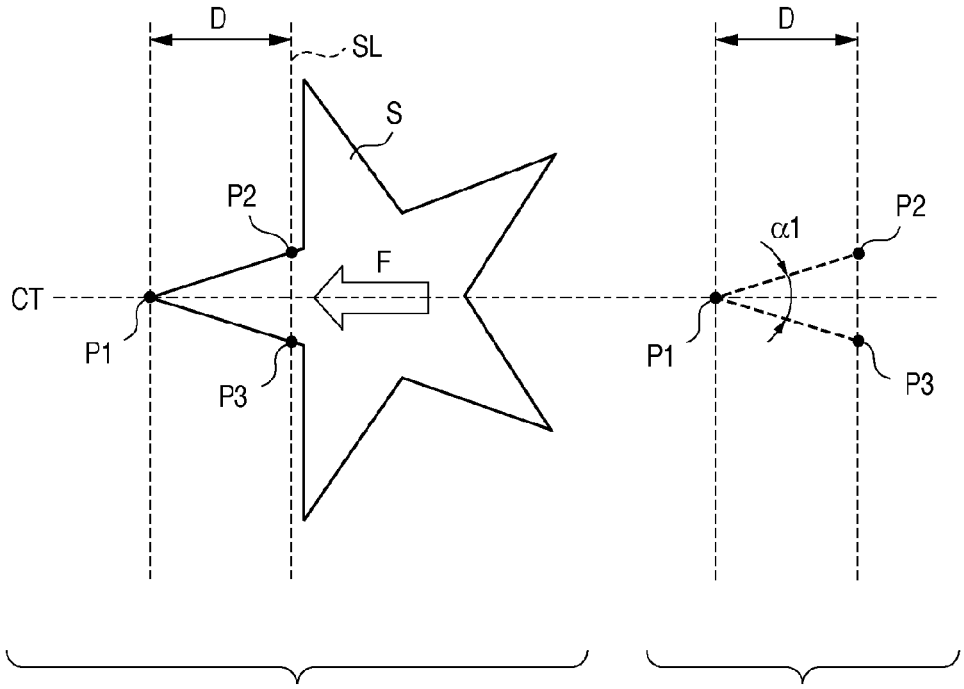
FIGS. 8A and 8B show a method for creating shape information regarding a transfer material that has a starburst outer shape.
Figures 9A, 9B, 9C, 9D:
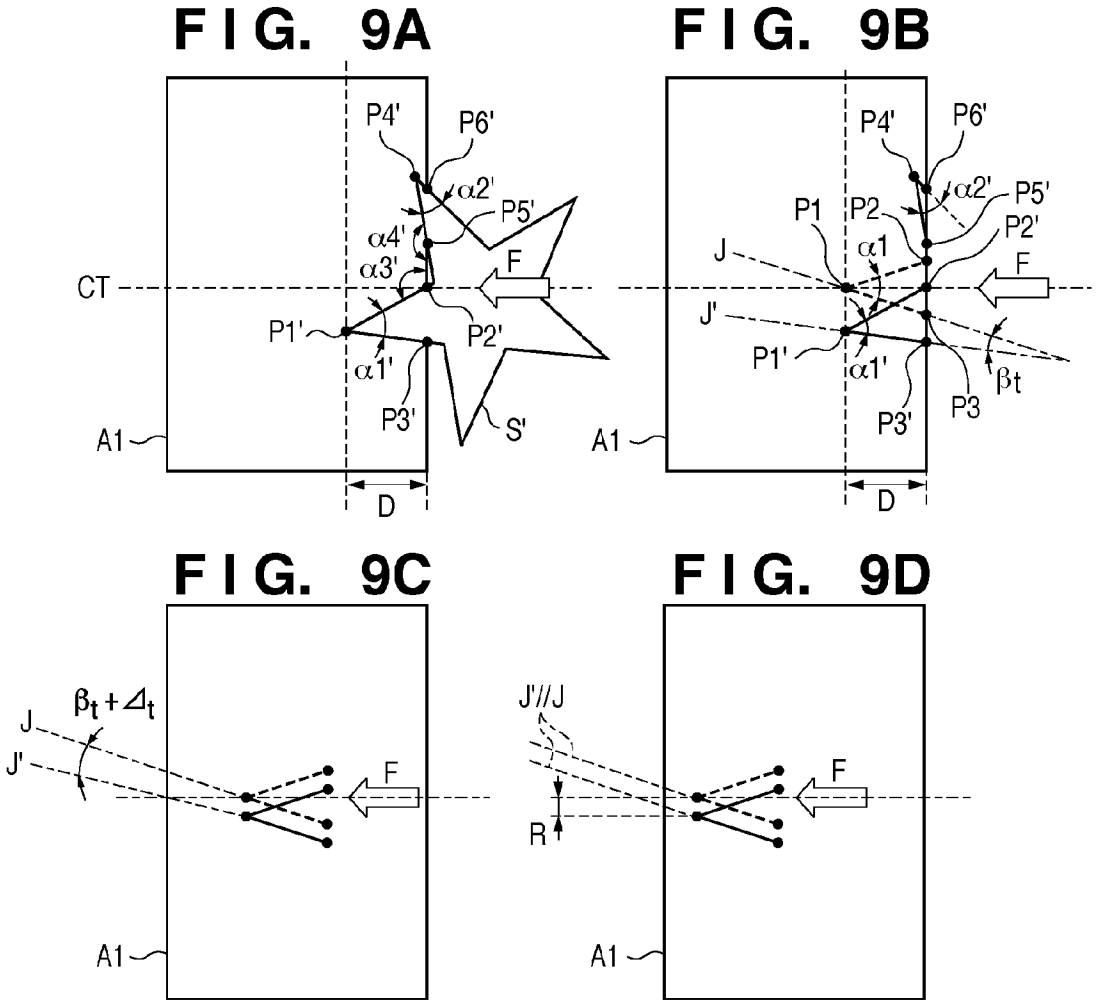
FIGS. 9A to 9D illustrate a concept of registration control according to a second embodiment.

FIGS. 8A and 8B show a method for creating shape information regarding a transfer material that has a starburst outer shape (in other words is star-shaped). Here, a concise description is given by assigning the same references to items already described. FIG. 8A shows a state in which the leading edge of a transfer material S has entered into the detection area A1 by a distance D. In FIGS. 8A and 8B, P1 denotes one peak of a starburst. P2 and P3 denote points where the outline of the transfer material S intersects with a straight line SL where the distance from the leading edge (point P1) of the starburst transfer material S is the distance D. The straight line SL is orthogonal to the conveying direction. FIG. 8B shows an angle $\alpha$1 formed by a line segment P3-P1 and a line segment P1-P2. In the present embodiment, such intersecting points are also used as characterizing points.

I. Shape Recognition Mode

The shape recognition mode disclosed in the first embodiment is also used in the second embodiment, but the simplification process in Step S505 is different. This is for compatibility with a recording medium having a distinctive shape, such as a starburst.

With an algorithm that extracts a point where a slope changes in an outline as a characterizing point, the shape information is simplified only at point P1. However, sufficient pattern matching cannot be executed in the job mode with only point P1. More specifically, elements for constituting at least one angle, that is, three points, are necessary in pattern matching. Thus, it is necessary that position information of at least three characterizing points is included in the simplified shape information.

In Step S505, as characterizing points, the CPU 301 extracts points P2 and P3 where the outline of the transfer material S intersects with the straight line SL, which is a straight line orthogonal to the conveying center line CT. The distance from the leading edge (point P1) of the transfer material S to the line SL is the distance D. The straight line SL corresponds to the side of the image, from among the four sides of the image, which is on the upstream side in the conveying direction. Furthermore, the CPU 301 computes an angle $\alpha$1 formed by a line segment P1-P2 and a line segment P2-P3. In Step S506, the CPU 301 writes shape information that includes the respective position information of points P1, P2, and P3 and the angle $\alpha$1 to the memory unit 302. Thus, from an image of a recording medium, the CPU 301 also determines an intersection of the outline of the recording medium and a line SL (or the side of the image on the upstream side in the conveying direction) as a characterizing point.

When there are less than three characterizing points (where a slope changes in an outline) in this way, it is possible to specify the position and orientation of the recording medium S by supplementing with intersections of the outline of the transfer material S and the side of the image on the upstream side in the conveying direction among the four sides of the image, as characterizing points.

II. Job Mode

The content of the registration control performed in the job mode is similar to the registration control performed in the first embodiment, but part of the processing is changed. For example, the simplification process in Step S702 is replaced by the simplification process of the shape recognition mode described in the second embodiment.

FIGS. 9A to 9D illustrate the concept of registration control according to the second embodiment. The registration control in the second embodiment is also divided into four phases, as described with reference to FIGS. 6A to 6D. The first phase (FIG. 9A), the second phase (FIG. 9B), the third phase (FIG. 9C), and the fourth phase (FIG. 9D) shown in FIGS. 9A to 9D respectively correspond to the first phase (FIG. 6A), the second phase (FIG. 6B), the third phase (FIG. 6C), and the fourth phase (FIG. 6D) shown in FIGS. 6A to 6D.

In the first phase (FIG. 9A), a state in which the leading edge of a transfer material S' has entered the detection area A1 by the distance D is shown. The CPU 301 executes Steps S701 and S702. That is, the CPU 301 obtains shape information of the transfer material S' and executes the simplification process. The simplification process in Step S702 is the same as the simplification process in the shape recognition mode of the second embodiment. First, the CPU 301 extracts points P1' and P4' as slope change points. Furthermore, the CPU 301 extracts points P2', P3', P5', and P6' as intersection points. Thus, the respective position information of six characterizing points is part of the shape information.

Furthermore, the CPU 301 connects points P1', P2', P3', P4', P5', and P6' in order with straight lines, and computes angles $\alpha 1'$, $\alpha 2'$, $\alpha 3'$, and $\alpha 4'$ formed by two adjacent line segments. The number of characterizing points defined in FIGS. 9A to 9D is three more than the number of characterizing points defined in FIGS. 8A and 8B because the transfer material S' is skewed.

In Step S703, the CPU 301 executes pattern matching, and compares angles $\alpha 1'$, $\alpha 2'$, $\alpha 3'$, and $\alpha 4'$ to angle $\alpha 1$ included in the reference data. As a result, $\alpha 1'=\alpha 1$ and $\alpha 2'=\alpha 1$, so it is clear that $\alpha 1'$ and $\alpha 2'$ are highly correlated with $\alpha 1$. That is, the corresponding relationship of characterizing points also is limited to P1'=P1 or P4'=P1. Thus, it is necessary for the CPU 301 to select P1'=P1 or P4'=P1.

Incidentally, it is desirable that the amount of correction by the first skew correction motor 21*a* and the second skew correction motor 21*b* is small. This is because when the correction amount is small, correction can be completed in a short period of time, and power consumption can be reduced. Therefore, the CPU 301 computes both the distance between points P1 and P1' and the distance between points P1 and P4', and compares the computed distances. The CPU 301 determines the point where the distance is shorter. In the example shown in FIGS. 9A to 9D, the distance between points P1 and P1' is shorter than the distance between points P1 and P4', so point P1' is extracted.

Afterward, in the second phase (FIG. 9B), the above-described straight lines J and J' are determined. In FIGS. 9A to 9D, the equation of the straight line J passing through points P1 and P3 and the equation of the straight line J' passing through points P1' and P3' are determined. The angle formed by the straight lines J and J' at time t is defined as an angle $\beta t$. The CPU 301 executes skew correction so as to bring the angle $\beta t$ near zero.

In the third phase (FIG. 9C), a time $\Delta t$ has further passed after the second phase (FIG. 9B), thus becoming time $t+\Delta t$. As a result of skew correction, the skew amount is reduced, so that the angle formed by the straight lines J and J' becomes $\beta t+\Delta t$, ($\beta t>\beta t+\Delta t$).

In the fourth phase (FIG. 9D), the straight lines J and J' are parallel. That is, skew correction has been completed. However, a position offset R in the width direction exists. Therefore, the CPU 301 drives the sliding motor 15 in order to reduce the position offset amount R to zero.

As described above, the same effects as the first embodiment can be obtained with the second embodiment. Furthermore, with the second embodiment, it is possible to maintain registration precision even in the case of irregularly shaped media having a shape such as a starburst.

In the second embodiment, when a plurality of parts that are geometrically the same are detected in pattern matching, the CPU 301 selects the part for which the correction amount is smallest. Thus, correction can be completed in a short period of time, and power consumption can be reduced. The algorithms for the shape simplification process and the pattern matching process described in the present embodiment are only examples. Other algorithms may be adopted as long as the same effects are obtained.

As also described in the first embodiment, it is not the case that both of the two skew correction roller pairs always sandwich the irregularly shaped media. When control of rotations of the skew correction motors is performed in a state in which only one skew correction roller pair is sandwiching the irregularly shaped media, there is a risk that the irregularly shaped media will be turned more than expected. Consequently, in the present embodiment, it is desirable that the area sensor 23 always monitors the relative positions of the two skew correction roller pairs and the irregularly shaped media. That is, the CPU 301 executes control of rotations of the skew correction motors only while both skew correction roller pairs are sandwiching a transfer material.

Figure 10:
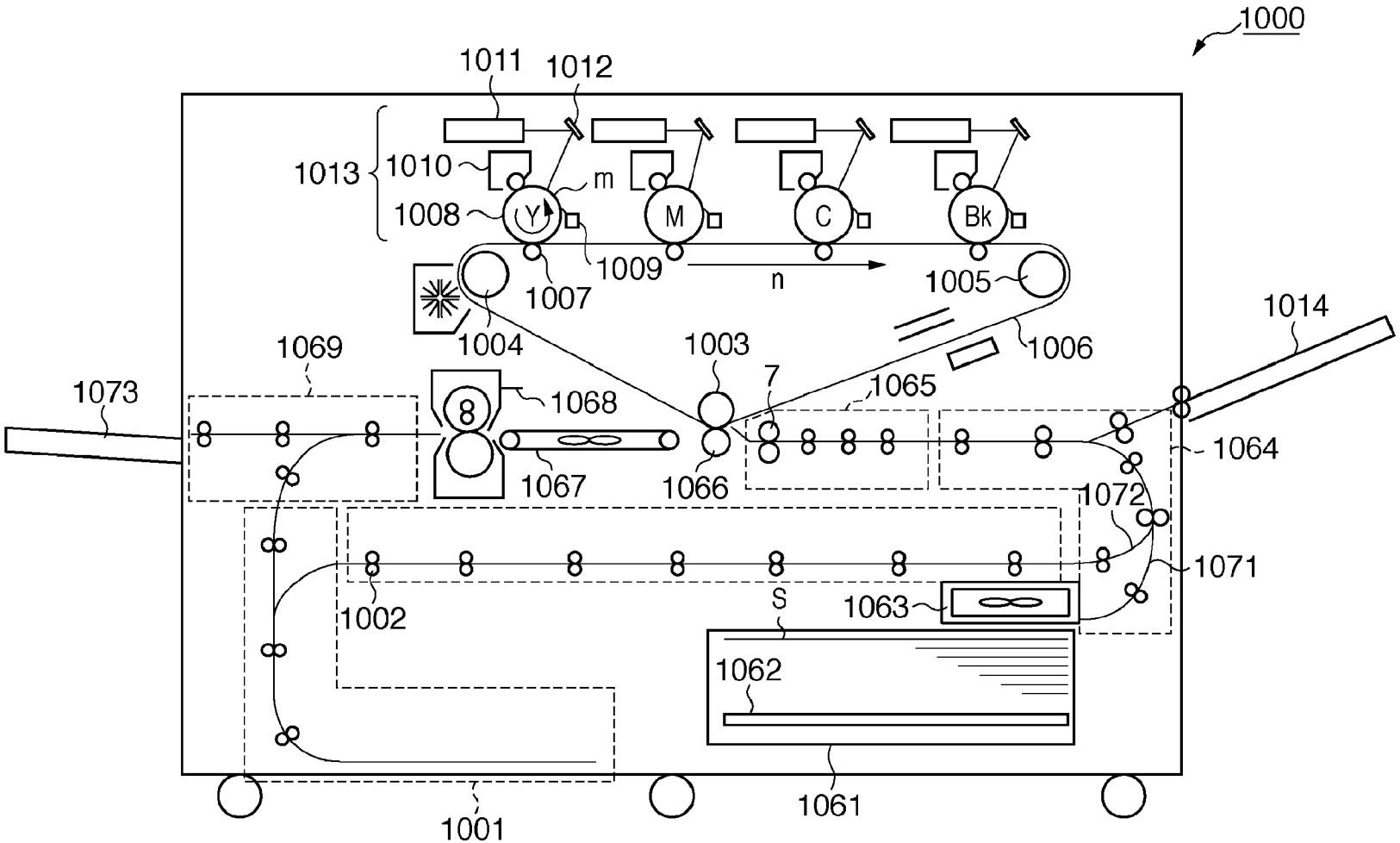
FIG. 10 shows a schematic cross-sectional view of an electrophotographic image forming apparatus.

FIG. 10 shows a schematic cross-sectional view of an electrophotographic image forming apparatus. Here, an image forming apparatus 1000 will be described as an example of application of the sheet conveying apparatus described in the first and second embodiments. Note that the image forming method is not limited to being an electrophotographic method, and may also be, for example, an offset printing method, an inkjet method, or the like. The image forming apparatus 1000 is provided with four image forming units that respectively form toner images of different colors.

Transfer Material Conveying Process

A transfer material S is stored stacked on a lift-up apparatus 1062 within a transfer material storage compartment 1061, and is supplied in coordination with the timing of image forming by a supply apparatus 1063. The paper supply apparatus 1063, for example, may employ a method in which frictional separation by supply rollers or the like is utilized, or a method in which separation/attachment by air is utilized, and the latter method is shown in FIG. 10. The transfer material S fed out by the supply apparatus 1063 is passed through a conveying path 1071 of a conveying unit 1064, and conveyed to a registration apparatus 1065. The registration apparatus 1065 is provided with the configuration for correcting skew and/or position offset described in the first and second embodiments. After skew and/or position offset correction and timing correction are performed in the registration apparatus 1065, the transfer material S is fed to a secondary transfer unit.

The secondary transfer unit is a toner image transfer nip unit that transfers a toner image to the transfer material S, and is formed by an opposing secondary transfer inner roller 1003 and secondary transfer outer roller 1066, and causes the toner image to adhere onto the transfer material S by applying a predetermined pressure and electrostatic load bias. In the case of irregularly shaped media, a path where the irregularly shaped media is merged into the registration apparatus 1065 directly from a separate manual feed supply unit 1014 may be selected. This is advantageous for conveyance of the irregularly shaped media because it is not necessary for the irregularly shaped media to pass through a curved unit such as the conveying path 1071.

Image Creation Process

Next is a description of the process of forming an image fed to the secondary transfer unit at the same timing as the process of conveying the transfer material S to the secondary transfer unit. The image forming unit 1013 mainly includes a photosensitive body 1008, an exposure apparatus 1011, a development apparatus 1010, a primary transfer apparatus 1007, a photosensitive body cleaner 1009, and so forth. The image forming unit 1013 is an example of an image forming unit that forms an image on a recording medium that has been conveyed by the sheet conveying apparatus.

The surface of the photosensitive body 1008 is uniformly charged in advance by a charging apparatus, and rotates in the direction of arrow m. The exposure apparatus 1011 outputs a light beam based on an image signal. The light beam exposes the surface of the photosensitive body 1008 by appropriately passing through a diffraction apparatus 1012. Thus, a latent image is formed. The electrostatic latent image formed on the photosensitive drum 1008 is made manifest as a toner image through toner development by the development apparatus 1010. A predetermined pressure and electrostatic load bias is applied to the toner image by the primary transfer apparatus 1007, and thus the toner image is transferred onto an intermediate transfer belt 1006. A small amount of toner remaining on the photosensitive body 1008 is recovered by the photosensitive body cleaner 1009. There are four image forming units 1013 that respectively correspond to yellow (Y), magenta (M), cyan (C), and black (Bk). The number of colors is not limited to four, and the order of colors is not limited.

The intermediate transfer belt 1006 is stretched across a drive roller 1004, a tension roller 1005, and the secondary transfer inner roller 1003, and rotates in the direction of arrow n. When toner images of respectively differing colors formed by the four image forming units 1013 are transferred in a stacked manner, a multi-color toner image is formed on the intermediate transfer belt 1006.

Processes after Secondary Transfer

Secondary transfer of a multi-color toner image onto the transfer material S is performed in the secondary transfer unit. The transfer material S is conveyed to a fixing apparatus 1068 by a pre-fixing conveying unit 1067. The fixing apparatus 1068 applies pressure and heat to the transfer material S and the toner image, thus melting and fixing the toner image on the transfer material S. The transfer material S is discharged onto a discharge tray 1073, or conveyed to a reverse conveying apparatus 1001. Switching of the conveying path is executed by a branch conveying apparatus 1069. When duplex image forming is needed, the transfer material S is fed to the reverse conveying apparatus 1001. In the reverse conveying apparatus 1001, switchback of the transfer material S is performed, and then the transfer material S is conveyed to a duplex conveying apparatus 1002. The transfer material S merges from a resupply path 1072 of the conveying unit 1064 into a main conveying path. The transfer material S is fed to the secondary transfer unit, and then image forming is executed for the back face (second face).

By adopting the sheet conveying apparatus described in the first and second embodiments in the image forming apparatus 1000, it is possible to form an image while maintaining registration accuracy even for irregularly shaped media. The above described embodiments refer to correcting skew and/or position offset of a printing medium, however an image to be formed on the medium may be rotated by the calculated skew amount instead of or in addition to rotating the medium. Japanese Patent Laid-Open No. 2003-122223 for example, discloses a suitable technique for correcting inclination of an image. An image to be formed on the medium may also be offset by an amount corresponding to the detected position offset amount. This may be performed in addition or instead of adjusting the position of the sheet itself.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-037055, filed Feb. 19, 2009, which is hereby incorporated by reference herein in its entirety.

What is claimed is:

1. A sheet conveying apparatus, comprising:

a storage unit that stores in advance first shape information that expresses at least a part of an outer shape of a sheet for which an orientation relative to a conveying direction has been designated;

an obtaining unit that obtains second shape information that represents at least the part of the outer shape of the sheet, the sheet being conveyed in a conveying path;

a skew amount computing unit that computes a skew amount of the sheet conveyed in the conveying path based on the first shape information and the second shape information;

a correction amount computing unit that computes a correction amount for correcting the skew of the sheet relative to the conveying direction from the computed skew amount; and a skew correction unit that corrects a skew angle with an image formed on the sheet and the sheet according to the computed correction amount;

the obtaining unit comprising:

an image-taking unit that takes an image of the sheet conveyed in the conveying path;

a position information determining unit that determines position information that represents the respective positions of at least three characterizing points that represent features of the outer shape of the sheet from the image taken by the image-taking unit; and an angle information determining unit that determines angle information that represents an angle formed by two straight lines obtained when the at least three characterizing points are connected by straight lines;

wherein the obtaining unit obtains the position information determined by the position information determining unit and the angle information determined by the angle information determining unit as the second shape information.

2. The sheet conveying apparatus according to claim 1, wherein the position information determining unit includes:

an outline extracting unit that extracts an outline of the sheet from the image taken by the image-taking unit, and an inflexion point determining unit that determines inflexion points of the extracted outline as the characterizing points.

3. The sheet conveying apparatus according to claim 1, wherein the position information determining unit includes:

an outline extracting unit that extracts an outline of the sheet from the image taken by the image-taking unit; and a characterizing point determining unit that determines, as the characterizing points, an inflexion point and intersection points of the outline of the sheet with a straight line, where the straight line is separated by a predetermined distance in the conveying direction of the sheet from the determined inflexion point.

4. The sheet conveying apparatus according to claim 1, wherein the skew amount computing unit includes an angle computing unit that computes an angle formed by a straight line that connects two characterizing points among the at least three characterizing points included in the first shape information and a straight line that connects two characterizing points corresponding to the two characterizing points in the first shape information among the at least three characterizing points included in the second shape information, and the correction amount computing unit computes the correction amount from the computed angle.

5. The sheet conveying apparatus according to claim 4, wherein the skew correction unit includes:

two skew correction roller pairs that are provided in a direction orthogonal to the conveying direction of the sheet and convey the sheet; and two motors that respectively drive the two skew correction roller pairs; and the correction amount computing unit respectively determines the rotational speed of the two motors based on the angle computed by the angle computing unit.

6. The sheet conveying apparatus according to claim 1, further comprising:

a position offset amount determining unit that determines a position offset amount in a direction orthogonal to the conveying direction of the sheet conveyed in the conveying path from the first shape information and the second shape information; and a position offset correction unit that corrects the position offset of the sheet based on the position offset amount determined by the position offset amount determining unit.

7. The sheet conveying apparatus according to claim 6, wherein the position offset correction unit is a roller pair that is capable of sliding in the direction orthogonal to the conveying direction while sandwiching the sheet.

8. The sheet conveying apparatus according to claim 1, further comprising:

an original reading apparatus that reads an image of an original;

a first shape information determining unit configured to determine the first shape information based on an image obtained from the original reading apparatus; and a write unit that writes the first shape information determined by the first shape information determining unit to the storage unit.

9. The sheet conveying apparatus according to claim 8, further comprising:

a display unit that displays the first shape information stored in the storage unit; and an editing unit that edits the displayed first shape information.

10. The sheet conveying apparatus according to claim 1, wherein the sheet conveying apparatus is capable of operation in a shape recognition mode in which the sheet is conveyed in order to obtain the first shape information to be stored in the storage unit, wherein the obtaining unit obtains the first shape information in the shape recognition mode and the sheet conveying apparatus further comprises:

a write unit that writes the first shape information determined by the first shape information determining unit to the storage unit.

11. The sheet conveying apparatus according to claim 10, further comprising:

a display unit that displays the first shape information stored in the storage unit; and an editing unit that edits the displayed first shape information.

12. An image forming apparatus, comprising:

the sheet conveying apparatus according to claim 1; and an image forming unit that forms an image on the sheet as a recording medium conveyed by the sheet conveying apparatus.

13. A sheet conveying apparatus, comprising:

a sheet conveying unit that conveys a sheet;

a storage unit that stores first shape information that expresses a plurality of inflexion points of the shape of an outline of the sheet, for which an orientation relative to a conveying direction has been designated, conveyed by the sheet conveying unit;

an image-taking unit that takes an image of the sheet conveyed by the sheet conveying unit;

a generating unit that detects the plurality of inflexion points of the shape of the outline of the sheet whose image is taken by the image-taken unit, and generates second shape information that expresses the detected plurality of inflexion points;

a skew amount measuring unit that measures a skew amount of the sheet conveyed by the conveying unit based on the first shape information stored in the storage unit and the second shape information generated by the generating unit; and a skew correction unit that corrects a skew angle with an image formed on the sheet and the sheet based on the skew amount measured by the skew amount measuring unit.

14. A method of conveying a sheet, the sheet having a non-rectangular sheet form, in a conveying apparatus, the method comprising:

conveying the sheet via a conveying unit, along a conveying path having a conveying direction;

taking an image with an image-taking unit, of at least part of the sheet conveyed by the sheet conveying unit;

obtaining via an obtaining unit, at least three characterizing points, of the outline of the sheet, from the image taken during the image taking step and generating via the obtaining unit, second shape information that represents the at least three characterizing points;

computing a correction amount via a computing unit, for correcting an image to be formed on the sheet and/or correcting the position and/or orientation of the sheet via a skew correction unit, using first shape information and the second shape information, wherein the first shape information, having a designated orientation relative to the conveying direction, is stored in a storage unit in advance and the first shape information represents at least three characterizing points of the outline of the sheet form and wherein the at least three characterizing points represented by the second shape information correspond to the at least three characterizing points represented by the first shape information; and correcting an image to be formed on the sheet and/or correcting the position and/or orientation of the sheet via the skew correction unit, based on the computed correction amount.

* * * * *